United States Patent [19]

Bell et al.

[11] 4,184,136

[45] Jan. 15, 1980

[54] FAST ACTING THERMAL RELAY

[75] Inventors: Lon E. Bell, Altadena; Robert W. Diller, Pasadena, both of Calif.

[73] Assignee: Technar, Incorporated, Arcadia, Calif.

[21] Appl. No.: 878,408

[22] Filed: Feb. 16, 1978

[51] Int. Cl.[2] ..... H01H 61/02; H01H 61/06

[52] U.S. Cl. ..... 337/141; 337/102; 337/138

[58] Field of Search ..... 337/102, 107, 99, 100, 337/92, 51, 52, 53, 372, 377, 141, 135, 136, 137, 138

[56] References Cited

U.S. PATENT DOCUMENTS

| | | | |
|---|---|---|---|
| 2,189,996 | 2/1940 | Riche | 337/53 |
| 2,489,391 | 11/1949 | Thomson | 337/53 |
| 2,776,352 | 1/1957 | Davis | 337/102 |
| 2,822,444 | 2/1958 | Colombo et al. | 337/141 |
| 3,174,012 | 3/1965 | Siiberg | 337/141 |
| 3,174,013 | 3/1965 | Siiberg | 337/141 |
| 3,201,547 | 8/1965 | Bleiweiss et al. | 337/141 |
| 3,305,654 | 2/1967 | Siiberg | 337/141 |
| 3,441,890 | 4/1969 | Prickett | 337/92 |
| 3,538,478 | 11/1970 | D'Entremont et al. | 337/107 |
| 3,805,060 | 4/1974 | Way | 337/141 |

*Primary Examiner*—Harold Broome

*Attorney, Agent, or Firm*—Christie, Parker & Hale

[57] ABSTRACT

A snap-action thermal relay in which a thin sheet of spring material having a central opening is mounted at one point along one edge and is crimped along an adjacent edge to distort the sheet into a slightly convex bowed shape. A heater element in the form of a thin band of metal is anchored at either end to the normally convex surface of the sheet adjacent opposite edges of the sheet, with a bridging member inserted between the band and the sheet to put the band under tension. A printed circuit heating element is applied to the band on the side opposite from the sheet. The tension in the band holds the sheet in a concave bowed condition. Heating of the bank reduces the tension in the band and allows the sheet to snap back to its normal convex bowed condition. This action brings the band into direct thermal contact with the convex surface of the sheet over a substantial length of the band to provide good conductive transfer of heat from the band and heater to the spring sheet.

12 Claims, 5 Drawing Figures

Fig. 1
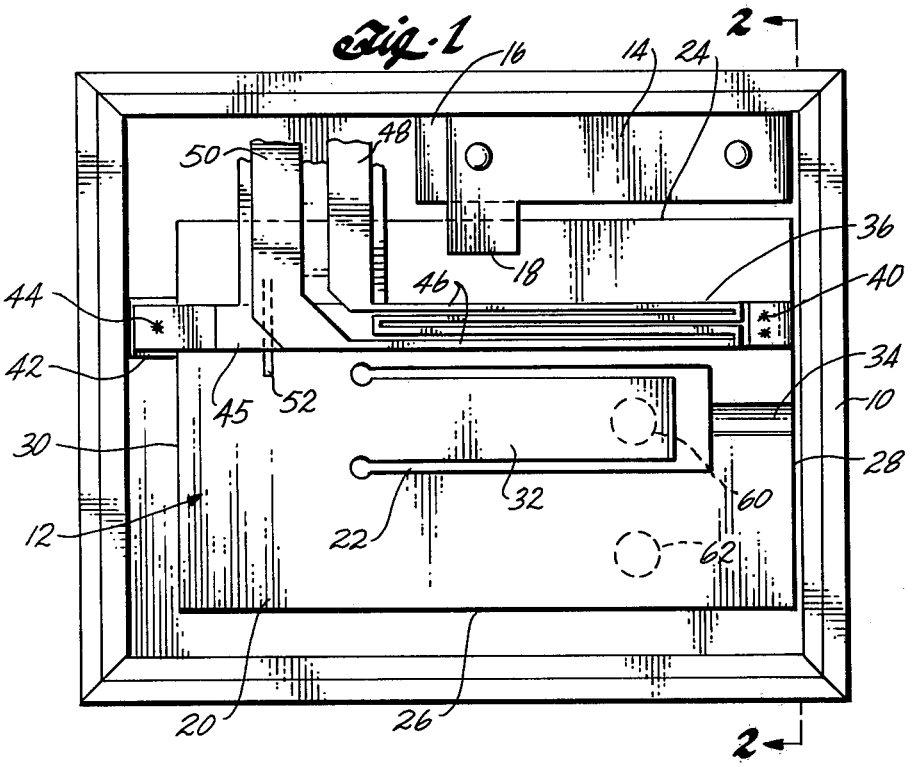
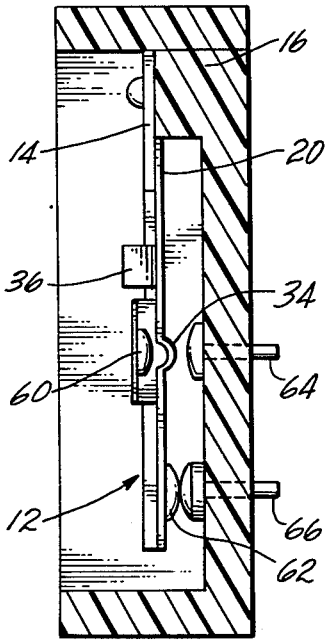
Fig. 2
Fig. 3
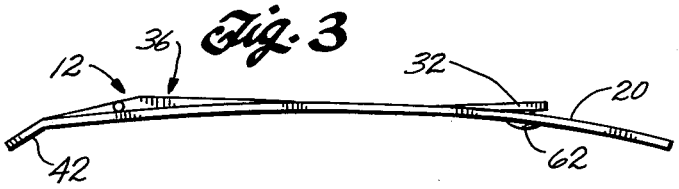
Fig. 4
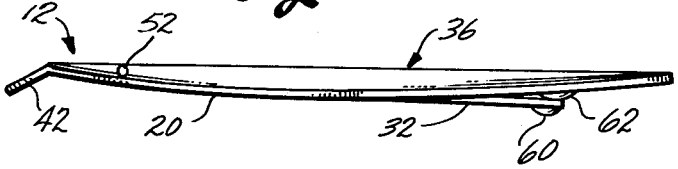
Fig. 5
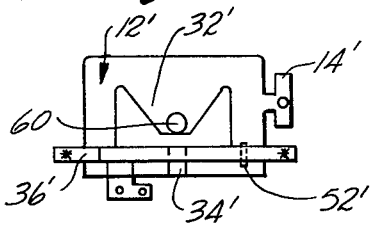

FAST ACTING THERMAL RELAY

FIELD OF THE INVENTION

This invention relates to a snap-action thermal sensitive device which can be used as a thermal relay.

BACKGROUND OF THE INVENTION

Thermally-operated switching devices used as relays, signal flashers, or the like, are well known. Such devices can be made snap-acting by providing an element which moves over center between two stable positions with heating or cooling of a thermal element. Bimetal relays in which a heater element causes heating of an active bimetal unit are well known. Such devices are inherently relatively slow acting because of large thermal masses involved. Snap-acting springs with separate tension bands or ribbons that are thermally heated and cooled to bend the spring have been proposed for switching devices, such as flashers. See U.S. Pats. Nos. 3,174,012 and 3,305,654, for example. The band can be made of very thin metal to provide a low thermal mass that can be more quickly heated and cooled than a bimetal element. Such devices have used the band as an electrical conductor to provide resistance heating. Also separate heaters spaced from the band have been used, or the band is wrapped with a resistance heater wire that is electrically insulated from the band. In such known devices the band does not make good thermal contact with the spring when the device is activated. Thus the rate of cooling by transfer of heat away from the band is relatively poor. This slows the rate at which the device can be cycled. Where the heater is separate from the band, the heat transfer from the heater to the band is further restricted.

SUMMARY OF THE INVENTION

The present invention is directed to a snap-acting thermal relay which produces a very high rate of response both in the closing and the opening cycles. This is accomplished by using a snap-acting spring and tension band in which the band is in relative thermal isolation during the heating operation, permitting a rapid increase in temperature, but once the spring element snaps to the closed position, the band moves into good thermal contact with the spring and is cooled rapidly, the spring acting as a heat sink to draw heat from the band. Thus the temperature rise of the band is limited by the action of the heat sink when the band moves into thermal contact with the spring. This self-limiting temperature effect permits the input power to the heater to be increased substantially without causing danger of destructive overheating from thermal overshoot. As a result of the increased input power level, the time required to actuate the switch is greatly reduced. Also, because of the high rate of heat transfer away from the band, after the heater is turned off, the release time is much faster. The relay of the present invention, since it is temperature self-limiting, also has much better overvoltage protection.

These and other advantages of the present invention are achieved in brief by providing a thermally-operated switch device in which a thin sheet of spring material having a central opening is supported at only a single point along one edge. The spring is formed into a convex bow shape by crimping the sheet along an adjacent edge. A thin metal tension band is attached to its ends at spaced points on the convex surface of the sheet, the tension in the band bending the sheet into a reverse or concave condition at normal operating temperatures. A printed circuit type heating element is formed on the surface of the band on the opposite side from the sheet. Heating of the band causes it to expand, releasing the tension in the band and allowing the sheet to bend into its normal convex shape, bringing the band into good thermal contact with the surface of the sheet along substantially the full length of the band, thereby limiting further temperature rise of the band due to the heater. When current to the heater is interrupted, the band rapidly loses its heat to the spring sheet, allowing the band to contract and bend the sheet back into its concave shape.

DESCRIPTION OF THE DRAWINGS

For a more complete understanding of the invention, reference should be made to the accompanying drawings, wherein:

FIG. 1 is a top view of the thermal relay of the present invention;

FIG. 2 is a sectional view taken substantially on the line 2—2 of FIG. 1;

FIG. 3 is an edge view of the switch element with the heater energized;

FIG. 4 is an edge view of the switching element with the heater not energized; and FIG. 5 is a top view of an alternative embodiment of the thermal relay of the present invention.

DETAILED DESCRIPTION

Referring to the drawings in detail, there is shown a thermal relay assembly according to the invention having an outer housing or case 10 preferably molded of plastic or other suitable nonconductive material. Mounted in the housing 10 is a switch assembly 12 which is supported in cantilever fashion by a bracket 14 secured to a shelf 16 integral with the housing 10. The bracket 14 may be integral with the switch assembly 12 or may be spot-welded or otherwise secured to one edge of the switch assembly 12, as indicated at 18.

The switch assembly 12 includes a thin rectangular sheet 20 of flexible metallic spring material, preferably beryllium copper. A substantially U-shaped opening 22 is formed in the central region of the spring sheet 20, the opening 22 forming an outer closed loop or rim which in effect has two parallel side leg portions 24 and 26, two parallel end leg portions 28 and 30. A central cantilever tongue 32 is also formed by the shape of the opening. As best seen in the end view of FIG. 2, the end leg portion 28 is shortened in length by forming a U-shaped crease 34 which crimps the leg portion 28. The end leg portion 28 in addition is bent slightly out of the horizontal plane on either side of the crease 34, the outer ends of the end leg 28 being bent away from the horizontal in the same direction as the crimp 34. The effect of this crimping and bending of the end leg portion 28 is to pull the ends of the side leg portions closer together and deform the parallel side leg portions 24 and 26 into a slightly bowed shape so that the top surface of the sheet, as viewed in FIG. 1, is slightly convex. This also causes the free end of the tongue 32 to normally project upwardly out of the plane of the sheet. The shape of the spring sheet as a result of the crimping is substantially as shown in FIG. 3.

Because the inner margins of the spring side leg portions 24 and 26 along either side of the opening 22 are placed in a state of compression by the crimping action, a bending force applied to the spring sheet in a direction to reverse the curvature of the bowed portions results in an over-center or snap-action in which the spring suddenly snaps into the reverse concave shape shown in FIG. 4. In the absence of any forces applied to the spring sheet, however, it will normally revert to the convex shape of FIG. 3.

The spring sheet 20 is held in the reverse concave shape of FIG. 4 by a tension band or ribbon 36 which is made of a very thin, narrow strip of material having a thermal coefficient of expansion which is closely matched to that of beryllium copper material of the spring sheet 20 and has high tensile strength. A suitable material is Alloy-C sold by Texas Instrument Company. One end of the band 36 is spot-welded to the top surface of the sheet 20 adjacent the crimped edge, as indicated at 40. The other end of the band 36 is spot-welded to a tab portion 42 extending out from the side leg portion 30 of the spring sheet 20, as indicated at 44. When secured in place, the band 36 is under sufficient tension under normal or ambient temperature conditions to hold the spring sheet 20 in the concave shape of FIG. 4. The matching thermal coefficients of the spring and band make the device insensitive to changes in ambient temperature.

The surface away from the spring sheet 20 at the top surface of the band (as viewed in FIG. 1) is overlayed over a portion of its length with a thin substrate of electrically insulating material, indicated at 45, on which is formed a printed circuit type heater element 46 terminating in a pair of output leads 48 and 50. When a voltage source is connected across the leads 48 and 50, a current passes through the element 46 which provides sufficient resistance to cause heating of the band 36.

A bridging element or spacer 52, which may be in the form of a fine wire or a small ridge formed in the surface of the spring sheet 20, is positioned between the band 36 and surface of the spring sheet 20. By bringing the band over the bridge 52, the tension in the band can be adjusted merely by bending the tab 42 slightly. This permits the switching assembly 12 to be adjusted to set the temperature at which the spring element 20 snaps over center from the concave condition of FIG. 4 into the convex condition of FIG. 3. This action occurs as current is applied to the element 46, causing the temperature of the band 36 to increase and the band to expand or lengthen, thereby relaxing the tension in the band.

A significant feature of the present invention is that once the band reaches the temperature at which it permits the spring sheet 20 to snap over center into the convex condition of FIG. 3, the under surface of the band 36 is brought into direct contact with the surface of the spring sheet 20 over full length of the heater element 46. This brings the band 30 into good thermal contact with the spring sheet 20. The spring sheet operates as a large heat sink, thereby limiting the rise in temperature of the band 36 from the heat generated by the heater element 46. Thus there is provided an overload protection mechanism which prevents the heater element from being burned out due to excessive temperatures resulting from a voltage overload. Also the power input to the heater can be greatly increased causing a very rapid increase in temperature of the band 36 without any significant thermal overshoot which otherwise could damage the heater.

Once the spring sheet 20 is allowed to snap into its normal convex shape shown in FIG. 3, the resulting switching action can be used to interrupt the current through the heater. Because of the good thermal contact between the band 36 and the spring sheet 20, once the heater current is interrupted, the band 36 will rapidly lose heat to the heat sink provided by the spring sheet, causing the temperature of the band to drop abruptly. As a result, the band will contract and cause the spring sheet 20 to be bent back into its concave shape shown in FIG. 4. It will be noted that as the spring sheet 20 snaps back and forth between the concave and convex positions, the free end of the tongue 32 moves in the opposite direction. A set of moving contacts 60 and 62 are secured to the spring sheet 20, respectively, adjacent the end of the tongue 32 and near one end of the side leg 26. A pair of opposed fixed contacts 64 and 66 supported by the housing 10 provide a single pole double-throw switching action. Thus it will be seen that the contacts 62 and 66 form a normally open switch when the heater is not energized, while the contacts 60 and 64 form a normally closed switch.

From the above description it will be seen that an improved thermal relay device has been provided which, because of the various design features described, is capable of extremely fast switching action, both opening and closing. Specifically, because of the very low thermal mass of the band 36, its temperature can be increased rapidly with relatively low input power. Further, because switching action causes the band 36 to snap into direct thermal contact with the spring sheet 20, a relatively high level of input power can be applied to the heater without risk of damaging thermal overshoot. This same self-limiting action is also important in protecting against over-voltage conditions which are frequently encountered in automobile electrical systems. The thermal contact between the band 36 and spring 20 also acts to accelerate the cooling rate of the band when power is interrupted to the heater, decreasing the time for the thermal relay t reset.

In the alternative embodiment of FIG. 5, the shape of the opening in the spring sheet 12' is modified to provide a tapered tongue 32'. Also the tension band 36' extends along the crimped edge of the spring sheet, rather than along the supported edge. The alternative design of FIG. 5 is merely to illustrate the variations in design which are possible in practicing the invention, but the arrangement of FIGS. 1–4 is preferred.

What is claimed is:

1. A thermally-operated switch apparatus comprising a thin sheet of spring material having an opening forming the sheet into an outer rim encircling the opening, the sheet being crimped at one point to shorten the perimeter of the rim and cause the rim to normally bow slightly in one direction, a thin metal strip secured adjacent either end to said sheet, the strip being positioned to one side of the opening, a bridge member between the strip and the sheet for putting the strip under tension and holding the sheet bowed in the reverse direction from said one direction, electrical resistance means applied to the surface of the strip, means for passing a current through the resistance means to heat the strip and expand its length, permitting the sheet to return to its normal bow in said one direction, the metal strip moving into direct thermal contact with the surface of the sheet over a substantial portion of the length of the strip when the sheet returns to its normal bow, frame means supporting the sheet at only one point along the edge, and electrical switch means including at least one contact carried by the sheet and at least one contact supported on the frame means for making and breaking electrical path as the sheet bows respectively in said one direction and in the reverse direction.

2. Apparatus of claim 1 wherein said electrical resistance means comprises a nonconductive layer applied to the strip, and a printed circuit heater conductor applied to the surface of the nonconductive layer.

3. Apparatus of claim 2 wherein the printed circuit heater conductor extends from adjacent one end of the strip to an intermediate point along the strip, the bridge being positioned adjacent the other end of the strip, whereby heating and expansion of the strip allows the heated portion of the strip to move into thermal contact with the spring sheet when the sheet returns to its normal bow in said one direction.

4. Apparatus of claim 3 wherein means for adjusting the tension of said strip includes a tab portion extending outwardly of one of the edges of the spring sheet, one end of the strip being attached to the tab portion, bending the tab relative to the rest of the spring sheet changing the tension of the strip.

5. A thermal relay comprising a housing, a sheet of spring metal having a normally convex surface, the spring metal sheet being anchored to the housing along one edge in cantilever fashion, a thin flat flexible metal band attached at either end to spaced points on the convex surface of the sheet to apply tension to the band and hold the sheet in the opposite direction with said normally convex surface held in a concave shape, and flexible heater means secured to and in direct thermal contact with only the side of the band away from the sheet between said ends of the band for heating the band and expanding its length to release the tension in the band, whereby said surface of the spring sheet is allowed to spring back to its normally convex shape, the band moving into direct contact with the convex surface of the spring as the band is heated.

6. Apparatus of claim 5 further including a pair of switch contacts, one of said contacts being supported from the housing and the other contact being movable by said spring sheet.

7. Apparatus of claim 5 wherein the spring sheet has a slot shaped to form a tongue portion in the center of the sheet, and a pair of switch contacts, one of said contacts being supported from the housing and the other contact being movable by said central tongue into and out of engagement with said one contact.

8. Apparatus of claim 5 wherein the spring and band have matching coefficients of expansion, whereby ambient temperature changes do not change the tension in the band.

9. Apparatus of claim 5 wherein the sheet includes a tab portion extending from one edge, one end of the band being secured to the tab.

10. Apparatus of claim 5 wherein the heater means includes a very thin substrate of electrically nonconductive material, and a thin conductive strip of metal plated on the substrate to form a current conductive path.

11. Apparatus of claim 5 further including a spacer between the band and the sheet, said spacer being substantially closer to one end of the band than the other, so as to divide the band into a short section and a long section on either side of the spacer, the heater means contacting the band along the length of the long section.

12. A thermally-operated switch apparatus comprising a thin sheet of spring material normally bowed slightly in one direction, a thin metal strip secured adjacent either end to said sheet, the strip being positioned to one side of the opening, a bridge member between the strip and the sheet for putting the strip under tension and holding the sheet bowed in the reverse direction from said one direction, electrical resistance means applied to the surface of the strip, means for passing a current through the resistance means to heat the strip and expand its length, permitting the sheet to return to its normal bow in said one direction, the metal strip moving into direct thermal contact with the surface of the sheet over a substantial portion of the length of the strip when the sheet returns to its normal bow, frame means supporting the sheet at only one point along the edge, and electrical switch means including at least one contact carried by the sheet and at least one contact supported on the frame means for making and breaking electrical path as the sheet bows respectively in said one direction and in the reverse direction.

* * * * *